US010047598B1

(12) United States Patent
Stephens

(10) Patent No.: US 10,047,598 B1
(45) Date of Patent: Aug. 14, 2018

(54) SUBSEA MONITOR SYSTEM

(71) Applicant: OneSubsea IP UK Limited, London (GB)

(72) Inventor: James Stephens, Richmond, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 15/668,750

(22) Filed: Aug. 4, 2017

(51) Int. Cl.

| | |
|---|---|
| ***E21B 19/00*** | (2006.01) |
| ***E21B 47/022*** | (2012.01) |
| ***E21B 47/06*** | (2012.01) |
| ***E21B 47/00*** | (2012.01) |

(52) U.S. Cl.
CPC ..... *E21B 47/0001* (2013.01); *E21B 19/002* (2013.01); *E21B 47/022* (2013.01); *E21B 47/06* (2013.01)

(58) Field of Classification Search
CPC .. E21B 19/002; E21B 47/0001; E21B 47/022; E21B 47/06
See application file for complete search history.

(56) References Cited

U.S. PATENT DOCUMENTS

| | | | | |
|---|---|---|---|---|
| 6,041,509 | A * | 3/2000 | Shelyago | E21B 47/01 33/304 |
| 6,370,784 | B1 * | 4/2002 | Hunter | E21B 47/022 33/365 |
| 6,386,291 | B1 * | 5/2002 | Short | E21B 33/0355 166/285 |
| 7,770,655 | B2 * | 8/2010 | Wilde | E21B 7/124 166/352 |
| 9,010,431 | B2 * | 4/2015 | Billington | E21B 19/002 166/250.01 |
| 9,091,604 | B2 * | 7/2015 | Kobata | E21B 44/00 |
| 9,145,737 | B2 * | 9/2015 | Kang | E21B 7/12 |
| 9,284,806 | B2 * | 3/2016 | Gutierrez | E21B 29/10 |
| 9,410,420 | B2 * | 8/2016 | Ross | E21B 47/122 |
| 9,810,044 | B2 * | 11/2017 | Bergeron | E21B 47/1025 |
| 2015/0204167 | A1 * | 7/2015 | Skeels | E21B 33/038 166/344 |
| 2016/0305232 | A1 * | 10/2016 | Bird | E21B 47/0001 |

* cited by examiner

*Primary Examiner* — Matthew R Buck
(74) *Attorney, Agent, or Firm* — Rodney Warfford; Bob Van Someren

(57) ABSTRACT

A technique provides for the combined use of a tool and a sensor system to deploy a subsea structural casing. The tool has an engagement region configured to couple with the subsea structural casing. The sensor system is operatively coupled with the tool and comprises a plurality of sensors. The sensors are used to monitor height of the subsea structural casing above a mud line as well as angular deviation of the structural casing during deployment of the subsea structural casing into a seabed.

17 Claims, 2 Drawing Sheets

SUBSEA MONITOR SYSTEM

BACKGROUND

Hydrocarbon fluids such as oil and natural gas are obtained from a subterranean geologic formation, referred to as a reservoir, by drilling a well that penetrates the hydrocarbon-bearing geologic formation. In subsea applications, structural casing may combine a low-pressure housing with a casing which is deployed into the seabed and set at a planned height above the mud line. Additionally, inclination of the structural casing is maintained within a maximum offset angle of, for example, 1.25° from vertical to facilitate interfacing with other subsea systems, e.g. blowout preventer, subsea tree, or tieback connector.

The structural casing may be jetted into position or set into a pre-drilled hole so the low pressure housing is close to the mud line but high enough above the mud line to allow remotely operated vehicle (ROV) intervention with respect to, for example, annulus valves. Generally, the height above the mud line is established via mud mats, mud sticks, and use of ROVs operated to assist in setting the elevation. The offset angle of the structural casing is monitored by a camera on the ROV looking at bull's eye targets. However, mud mats and mud sticks are substantial capital investments that are not recovered. Additionally, use of the ROV(s) tends to be relatively expensive and the cameras can be unusable for substantial time periods with respect to reading targets following a jetting operation to install the structural casing.

SUMMARY

In general, a system and methodology are provided for the combined use of a tool and a sensor system to deploy a subsea structural casing. The tool has an engagement region configured to couple with the subsea structural casing. The sensor system is operatively coupled with the tool and comprises a plurality of sensors. The sensors are used to monitor height of the subsea structural casing above a mud line as well as angular deviation of the structural casing during deployment of the subsea structural casing into a seabed.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology for the combined use of a deployment tool and a sensor system to deploy a subsea structural casing. For example, the subsea structural casing may be deployed into a hole in the seabed once the hole is formed by, for example, jetting or drilling. The subsea structural casing is used in cooperation with a subsea well to enable desired well operations such as production of petroleum and/or other well fluids.

According to an embodiment, the tool has an engagement region configured to couple with the subsea structural casing. By way of example, the engagement region may be in the form of a circumferential region which is inserted into the subsea structural casing to enable manipulation of the subsea structural casing. The tool and structural casing may be joined in a sealed engagement.

The sensor system is operatively coupled with the tool and comprises a plurality of sensors. By way of example, the sensor system may be directly coupled with the tool and positioned at a suitable location such as a location disposed above the tool. The sensors are used to monitor height of the subsea structural casing above a mud line as well as angular deviation of the structural casing during deployment of the subsea structural casing into a seabed. This ensures, for example, the subsea structural casing extends a desired distance above the mud line and within a desired angular deviation limit with respect vertical (e.g. within 1.25° of vertical) once the subsea structural casing is set in the seabed. In some embodiments, the sensor system may be used to monitor additional parameters.

Figure 1:
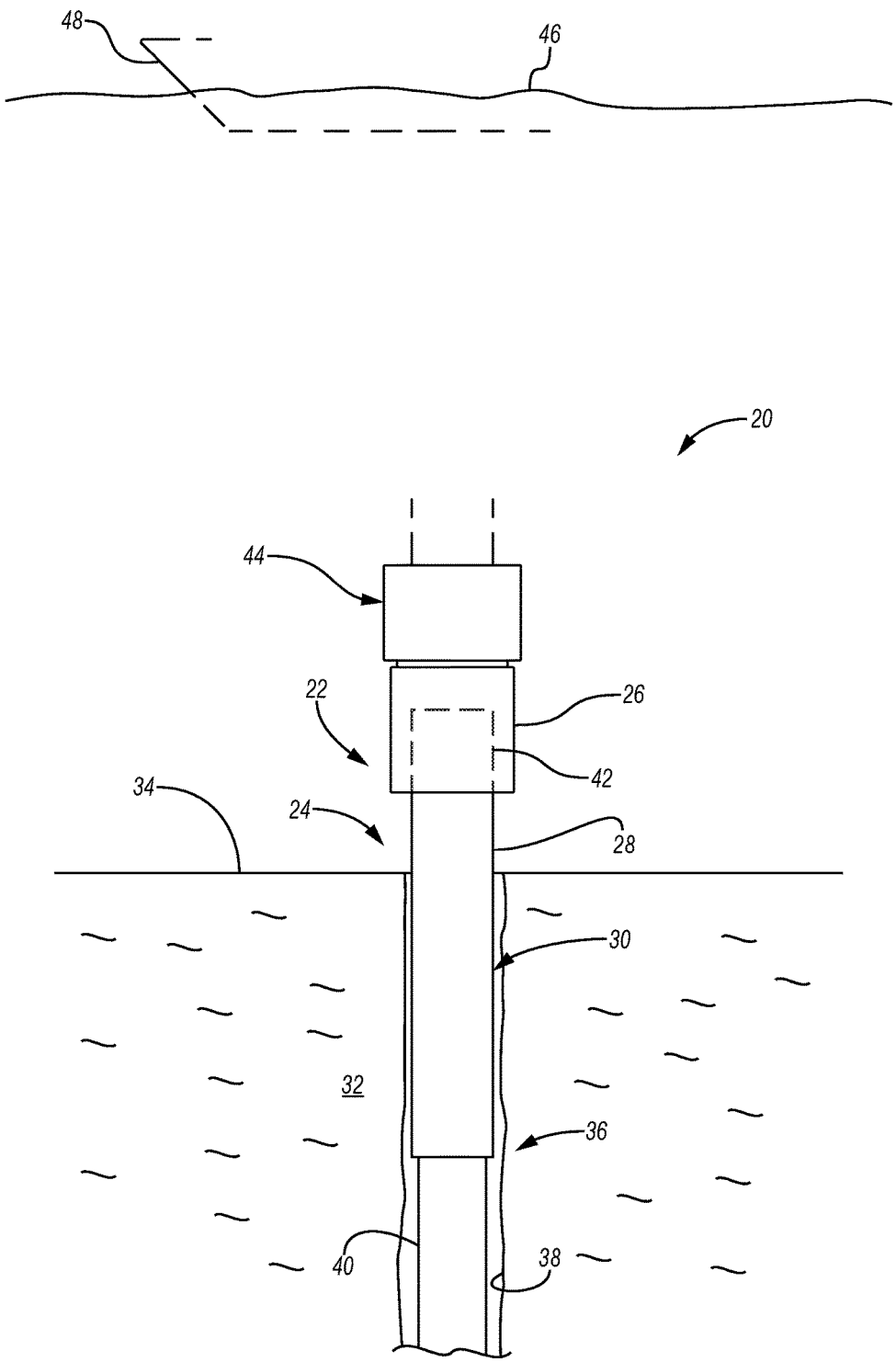
FIG. 1 is a schematic illustration of an example of a subsea well system in which structural casing has been deployed into a seabed at a subsea well location, according to an embodiment of the disclosure.

Referring generally to FIG. 1, an example of a subsea well system 20 is illustrated. The subsea well system 20 may be used in a variety of subsea well applications and generally comprises a structural casing 22 which may be deployed at a suitable subsea location 24. Depending on the parameters of a given subsea operation, the structural casing 22 may comprise a low pressure housing 26 mounted over the top end of a tubular casing 28. By way of example, the subsea low pressure housing 26 may be in the form of a subsea wellhead housing combined with the tubular casing 28 to form, in this example, a supporting/anchoring system 30. In some applications, the combined housing 26 and casing 28 may be referred to as a conductor.

In the illustrated example, the structural casing 22 extends into a seabed 32, e.g. into a subsea geologic formation, at the subsea location 24. The tubular casing 28 is inserted into the seabed 32 a desired distance so as to position the subsea low pressure housing 26 at a desired spacing above a sea floor 34, e.g. above a mud line. The structural casing 22 may be used at a subsea well 36 having a wellbore 38 extending down into the seabed/geologic formation 32. Various types of well tubulars 40, e.g. casing, production tubing, completion components, tubular equipment, may be suspended from, positioned in, positioned below, and/or otherwise located with respect to the structural casing 22.

According to an embodiment, an upper end 42 of casing 28 is inserted into an interior of subsea low pressure housing 26 and secured thereto in sealed engagement. Depending on the parameters associated with a given subsea operation, various types of subsea installation equipment 44 may be coupled with structural casing 22, e.g. with low pressure housing 26. By way of example, subsea equipment 44 may comprise portions of a subsea wellhead as well as other equipment mounted to the subsea wellhead, e.g. a blowout preventer. In some applications, risers or other equipment may extend upwardly above the subsea wellhead housing 24 toward a surface 46. Various types of surface facilities 48 such as surface vessels, platforms, or other surface facilities may be located at surface 46 generally above well 36 to facilitate, for example, drilling operations, completion operations, production operations, or other well related operations.

Figure 2:
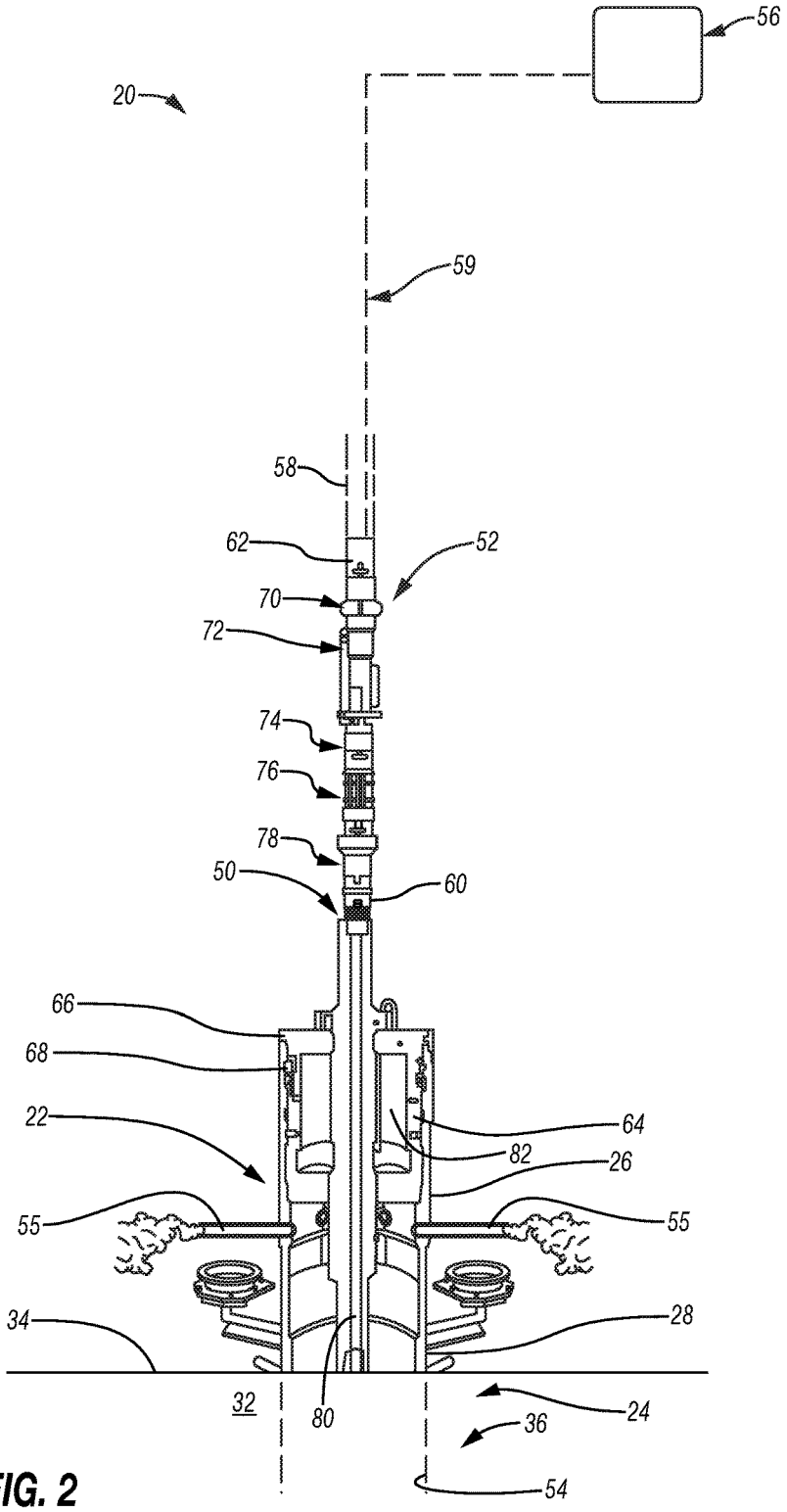
FIG. 2 is a partial cross-sectional illustration of an example of a deployment tool combined with a sensor system to facilitate deployment of the structural casing to a desired height above the mud line and within a desired offset angle with respect vertical, according to an embodiment of the disclosure.

To ensure proper coupling and operation of the subsea installation equipment 44, the structural casing 22 is positioned to extend a desired height above the mud line 34 and at an orientation within a desired angle of deviation with respect to vertical. As illustrated in FIG. 2, a tool 50 is used in cooperation with a sensor system 52 to ensure positioning of the structural casing 22 at the desired height above the subsea mud line 34 and within a desired range of angular deviation of the structural casing 22 with respect to vertical. In some embodiments, the sensor system 52 comprises sensors for measuring weight of a structural string if the structural casing 22 is sinking and/or depth of a drill bit if a hole is being drilled when the structural casing 22 is set.

In an operational example, the tool 50 is initially connected to the structural casing 22. By way of example, the tool 50 initially may be connected to structural casing 22 at the surface facility 48 located at surface 46. The tool 50 is then used to deploy the structural casing 22 to the desired subsea location 24. Additionally, the tool 50 may be used to move the structural casing 22 into a hole 54 formed in the seabed 32. Hole 54 may be the upper end of wellbore 38.

By way of example, the hole 54 may be formed by jetting as the structural casing 22 is lowered; or the structural casing 22 may be dropped into a hole 54 formed via drilling. According to one type of embodiment, the hole 54 is formed by directing a powerful jet into the seabed 32 and allowing the displaced seabed material to escape from the interior of structural casing 22 via jets 55 as illustrated. During deployment into and setting of the structural casing 22 in hole 54, the sensor system 52 is used to monitor the height of the structural casing 22 above the subsea mud line 34 as well as the angular deviation of the structural casing 22.

The sensor system 52 may be operatively coupled with the tool 50 and may provide data to a surface control system 56 located on, for example, the surface facility 48. The surface control system 56 may be a computer-based control system which processes data from sensor system 52. The processed data is then used by surface control system 56 to provide directions for controlling deployment equipment 58. The deployment equipment 58 is used, in turn, for manipulating the tool 50. Depending on the parameters of a given operation and environment, the sensor system 52 and surface control system 56 may communicate via a suitable wired or wireless telemetry system 59.

In some embodiments, the sensor system 52 may be coupled directly and rigidly to the tool 50. For example, the sensor system 52 may be mounted on the tool 50 via a mechanical coupling 60. In the illustrated embodiment, the sensor system 52 is coupled with tool 50 via coupling 60 and extends above the tool 50 such that the sensor system 52 moves and tilts with tool 50. The deployment equipment 58 may comprise cable, coiled tubing, other types of tubing, or other suitable equipment controllable to manipulate the height and angular orientation of the structural casing 22. Depending on the structure of tool 50 and sensor system 52, the deployment equipment 58 may be connected directly to one or both of the tool 50 and sensor system 52 via, for example, a mechanical coupling 62.

In the embodiment illustrated, the tool 50 comprises an engagement region 64 which may be inserted into the upper end of structural casing 22. For example, engagement region 64 may be inserted into the interior of low pressure housing 26 until stopped by an abutment portion 66 of engagement region 64. A latch mechanism 68 or other suitable retention mechanism may be used to secure tool 50 to structural casing 22 until the structural casing 22 is set at the appropriate height and angular orientation.

If the structural casing 22 has been placed in a drilled hole, the latch mechanism 68 may then be released and tool 50 may be withdrawn from structural casing 22 to allow engagement of structural casing 22 with other subsea installation equipment, e.g. equipment 44. If, on the other hand, the structural casing 22 has been placed via a jetting procedure, the tool 50 may then be manipulated in such a way so it can pass through the structural casing 22 and allow a mud motor and drill bit to continue drilling the next hole to a desired depth. In some embodiments, the sensor system 52 may be used to determine desirable depths, such as depth of the drill bit. Once a desired depth is drilled, the tool 50 may be retrieved back through the structural casing 22. In some applications, the tool 50 may engage a running tool which remained in the structural casing 22 during drilling, and then the tool 50 and drill bit can be retrieved together. It should be noted the latch mechanism 68 may be selectively released via hydraulic input, mechanical input, or other suitable input based on the type of lighting mechanism. Depending on the parameters of a given operation, various subsequent wellbore formation processes, production processes, or other well related processes may be conducted upon release of tool 50.

Additionally, sensor system 52 may comprise various different types of sensors to measure desired parameters associated with a given operation. For example, the sensor system 52 may comprise different types of sensors to monitor height above the mud line 34 and also the angular deviation of structural casing 22 from vertical. By way of example, sensor system 52 may comprise various combinations of sensors which may include a gyro 70, an altimeter 72, an inclinometer 74, a load cell 76, and a pressure sensor 78. At least two of the sensors 70, 72, 74, 76, 78 and sometimes the entire group of sensors may be used to provide data to the surface control system 56.

Surface control system 56 processes the data and the resulting processed data allows the surface control system 56 to provide inputs to deployment equipment 58 so as to adjust the height and angular inclination of structural casing 22. For example, data from the altimeter 72 may be used to determine height of the low pressure housing 26 above mud line 34. Similarly, data from gyro 70 and inclinometer 74 may be used to determine the angle of deviation of structural casing 22 relative to vertical. Data from the load cell 76 may be used to monitor weight, e.g. to monitor weight if the structural casing 22 is sinking.

Based on this data, the surface control system 56 is able to provide control signals to an operator and/or to the surface system controlling deployment equipment 58 so as to adjust the height and/or angular inclination of structural casing 22. Other types of sensors and arrangements of sensors may be employed to provide the desired data on height and inclination as well as on other parameters. For example, data from load cell 76 and pressure sensor 78 may be used in determining coupling and uncoupling of tool 50 as well as determining whether the structural casing 22 continues to move into seabed 32 during deployment. Various other sensors and combinations of sensors may be used to monitor these parameters and/or additional parameters.

In an operational example, well construction for a subsea application begins by deploying and setting the structural casing 22 at a planned height (e.g. 2-4 meters) above the mud line 34 and within a predetermined deviation angle with respect to vertical (e.g. within 1.5° of vertical). Use of the sensor system 52 enables setting of the structural casing 22 without using conventional mud mats, mud sticks, and ROVs for assisting in determining elevation.

By monitoring elevation and inclination angle of tool 50 and structural casing 22 (via sensor system 52 mounted to tool 50), the entire setting operation can be performed with reduced ROV usage and without incurring the expense of conventional mud mats and mud sticks. Furthermore, the sensor system 52 enables monitoring of elevation and inclination even if the soil of seabed 32 is disturbed during jetting of hole 54.

Depending on the specifics of a given use, the shape, size, and features of structural casing 22 may be adjusted. For example, the structural casing 22 may have various diameters for use with various types of subsea wells. Similarly, the tool 50 may have various sizes and configurations for coupling with the structural casing 22. In some embodiments, the tool 50 may comprise a longitudinal passage 80 through which jetting fluid may be delivered. The tool 50 also may comprise a pressure chamber or chambers 82 for use in hydraulically setting and/or releasing latch mechanism 68. However, these and other features may be changed or added to facilitate use of tool 50 with various types of structural casing 22 in different types of environments. Additionally, the sensor system 52 may comprise various types of sensors in place of or in addition to the illustrated sensors 70, 72, 74, 76, 78 depending on the parameters of a given operation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a subsea well operation, comprising:

a structural casing having a subsea low pressure housing and a tubular casing with an upper end inserted into the subsea low pressure housing in sealing engagement;

a tool having an engagement region inserted into an upper end of the structural casing until the tool is sufficiently coupled to the structural casing to enable releasable latching of the tool to the structural casing and manipulation of the structural casing when deployed and set at a subsea location;

and a sensor system mounted to the tool to monitor height above a subsea mud line and an angular deviation of the structural casing from vertical during deployment of the structural casing into a seabed.

2. The system as recited in claim 1, wherein the sensor system is rigidly coupled directly to the tool.

3. The system as recited in claim 1, wherein the sensor system is mounted above the tool.

4. The system as recited in claim 1, wherein the sensor system comprises a plurality of different types of sensors.

5. The system as recited in claim 4, wherein the plurality of different types of sensors comprises a gyro.

6. The system as recited in claim 4, wherein the plurality of different types of sensors comprises an altimeter.

7. The system as recited in claim 4, wherein the plurality of different types of sensors comprises an inclinometer.

8. The system as recited in claim 4, wherein the plurality of different types of sensors comprises a load cell.

9. The system as recited in claim 4, wherein the plurality of different types of sensors comprises a pressure sensor.

10. The system as recited in claim 4, wherein the plurality of different types of sensors comprises a gyro, an altimeter, an inclinometer, a load cell, and a pressure sensor.

11. A system, comprising:

a tool having an engagement region configured to couple with a subsea structural casing, the engagement region being inserted into an upper end of the structural casing until the tool is sufficiently coupled to the structural casing to enable manipulation of the structural casing when deployed and set at a subsea location;

a sensor system coupled with the tool, the sensor system comprising sensors to monitor height above a subsea mud line and an angular deviation of the subsea structural casing from vertical during deployment of the subsea structural casing into a seabed; and the subsea structural casing coupled to the tool, the subsea structural casing comprising a subsea wellhead housing and a tubular casing with an upper end inserted into the subsea wellhead housing in sealing engagement.

12. The system as recited in claim 11, wherein the sensor system is mounted to the tool at a position above the tool.

13. The system as recited in claim 11, wherein the sensors comprise a gyro, an altimeter, an inclinometer, a load cell, and a pressure sensor.

14. A method, comprising:

providing a structural casing comprising a subsea wellhead housing and a tubular casing with an upper end inserted into the subsea wellhead housing in sealing engagement;

connecting a tool to the structural casing by inserting an engagement region of the tool into an upper end of the structural casing;

deploying the tool and the structural casing together to a subsea location;

moving the structural casing into a hole in a seabed;

using a sensor system to monitor height of the structural casing extending above a subsea mud line and an angular deviation of the structural casing from vertical as the structural casing is moved into the hole; and adjusting the orientation of the structural casing based on data provided by the sensor system until the structural casing is within 1.5° of vertical.

15. The method as recited in claim 14, wherein moving comprises positioning a low pressure housing of the structural casing at a desired height above the mud line.

16. The method as recited in claim 14, wherein using comprises using at least two of a plurality of sensors in the form of a gyro, an altimeter, an inclinometer, a load cell, and a pressure sensor.

17. The method as recited in claim 14, further comprising mounting subsea installation equipment to the structural casing.

* * * * *